US007967702B2

(12) United States Patent
Winskowicz et al.

(10) Patent No.: US 7,967,702 B2
(45) Date of Patent: Jun. 28, 2011

(54) GOLF BALL WITH WATER IMMERSION INDICATOR

(75) Inventors: Robert Winskowicz, North Andover, MA (US); Edward D. Kingsley, Concord, MA (US); David Michael Lynn, Middleton, WI (US); Daniel Griffith Anderson, Framingham, MA (US)

(73) Assignee: Performance Indicator, LLC, Lowell, MA (US)

( * ) Notice: Subject to any disclaimer, the term of this patent is extended or adjusted under 35 U.S.C. 154(b) by 997 days.

(21) Appl. No.: 10/821,763

(22) Filed: Apr. 9, 2004

(65) Prior Publication Data

US 2005/0227789 A1 Oct. 13, 2005

(51) Int. Cl.
*A63B 37/12* (2006.01)

(52) U.S. Cl. ..... 473/378; 473/353; 473/409

(58) Field of Classification Search ..... 473/351, 473/378, 353

See application file for complete search history.

(56) References Cited

U.S. PATENT DOCUMENTS

| | | | | |
|---|---|---|---|---|
| 5,356,149 | A | 10/1994 | Kane | |
| 5,823,891 | A | 10/1998 | Winskowicz | |
| 5,938,554 | A | 8/1999 | Moster et al. | |
| 6,277,037 | B1 | 8/2001 | Winskowicz et al. | |
| 6,358,160 | B1 * | 3/2002 | Winskowicz | 473/378 |
| 6,623,382 | B2 | 9/2003 | Winskowicz | |
| 6,638,160 | B2 | 10/2003 | Yoshitomi | |
| 2002/0094885 | A1 * | 7/2002 | Finkel | 473/351 |
| 2003/0109329 | A1 * | 6/2003 | Kennedy, III | 473/351 |
| 2003/0114254 | A1 * | 6/2003 | Emalfarb | 473/378 |

* cited by examiner

*Primary Examiner* — Raeann Trimiew
(74) *Attorney, Agent, or Firm* — Ira M. Turner

(57) ABSTRACT

In order to provide a golf ball with a water immersion indicator, a golf ball with indicia or a particular recognizable color is overlain with an opacification layer that provides a mask over the indicia or the colored ball until such time as the ball has been immersed in water for a predetermined period of time affecting the ball's performance. The opacification layer when removed or otherwise made transparent, while providing for a change in the appearance of the golf ball upon water immersion, does not need to have a layer or indicia which changes color in reaction to the infusion of water. Rather the opacification layer is either removed or made transparent to expose an underlying colored surface or a surface bearing pre-determined indicia, thus to alter the appearance of the ball when it has been immersed in water for a period of time which affects golf ball properties. The subject system provides an easy way to make indicia visible upon water immersion since one does not have to create the indicia in response to water activation, but rather uncover already-printed indicia due to the removal or transparency of the opacification layer. Opacification reduction or elimination is accomplished through a number of physical processes involving a water-activated binder and either insoluble pigment particles, effervescing bubbles, the use of transparent oils, agglomeration or the complete or partial removal of the opacification layer.

30 Claims, 10 Drawing Sheets

GOLF BALL WITH WATER IMMERSION INDICATOR

FIELD OF THE INVENTION

This invention relates to golf balls with water immersion indicators and more particularly to the utilization of an opacification layer over a portion of the ball which either bears an appropriate indicia, or one which is colored, such that when the opacification layer is exposed to water immersion, the underlying indicia or color is unmasked.

BACKGROUND OF THE INVENTION

Generally, gold balls are one of three types. A first type is a multi-piece wound ball wherein a vulcanized rubber thread is wound under tension around a solid or semi-solid core, and thereafter enclosed in a single or multi-layer covering of tough, protective material. A second type of golf ball is a one-piece ball formed from a solid mass of a resilient material that has been cured to develop the necessary degree of hardness to provide utility. One-piece molded balls do not have second enclosing cover. A third type of ball is a multi-piece non-wound ball that includes a liquid, gel or solid core of one or more layers and a cover having one or more layers formed over the core.

Attempts to improve and/or optimize performance characteristics in golf balls are typically directed toward achieving better feel when the ball is struck with a golf club, and also allowing for increased or optimum distance while at the same time adhering to the rules set forth by the United States Golf Association (U.S.G.A.) regarding the physical characteristics and performance properties of golf balls. These rules specify that the weight of a golf ball shall not be greater than 1.620 ounces, the diameter of the ball shall not be less than 1.680 inches and the velocity of the ball shall not be greater than 255 feet per second (250 feet per second with 2% tolerance level). The U.S.G.A. rules also specify that the overall distance a golf ball should travel shall not cover an average distance (in carry and roll) greater than 280 yards, plus a 6% tolerance level (296.8 yards total).

As recited in U.S. Pat. Nos. 5,823,891; 5,938,554; 6,277,037; 6,638,160; and 6,623,382, all assigned to the assignee hereof, a golf ball immersion indicator is described in which upon immersion of the golf ball, for instance in a pond, the appearance of the golf ball is changed so that the fact of its having been immersed is readily apparent to the golf ball user, thus to indicate a loss of performance.

While the above patents disclose various methods for changing the appearance of a golf ball that has been immersed or otherwise exposed to water for relatively long periods of time, in these patents the change in appearance is at least in some instances due to a color change induced by water immersion. This implies the utilization of layers of water-sensitive dyes or other materials which upon immersion either create or change their color.

Note that U.S. Pat. No. 6,358,160 utilizes water-activated ink which either appears or disappears upon the immersion of the golf ball in water. It will be appreciated that if the ink disappears then it is the ink itself which provides the water immersion indicia by altering the appearance of the golf ball through its absence.

In short, all of the above patents provide for the creation of color within a layer or imprint, or provide for the disappearance of the layer or imprint which is part of the layer in a color change operation within or on the layer.

This requires the application to a golf ball structure of a layer which in and of itself serves as the indicator.

By way of further background, in the past, an injected molded, water soluble golf ball is described in U.S. Pat. No. 5,356,149 issued to Patrick E. Kane on Oct. 18, 1994. The purpose of this golf ball was to be able to be used off the fantail of a cruise ship, with the golf ball completely disintegrating when it had been immersed and left in sea water. It will be appreciated that the golf ball itself is not again playable and therefore does not constitute a playable golf ball.

SUMMARY OF INVENTION

Rather than incorporating as the appearance-changing aspect of a golf ball the fact of a color change in a particular layer applied to a golf ball, in the subject invention, an opacification or masking layer covers an underlying golf ball immersion-indicating surface.

For purposes of the subject invention immersion includes both total and partial immersion in water or the exposing of the golf ball to water for relatively long periods of time, namely days as opposed to minutes.

The surface that is opacified may have a distinctive color to indicate immersion or may bear indicia indicating immersion. Under normal conditions the opacification layer blocks the view of the underlying surface.

When the opacification layer is water-activated it becomes transparent or is removed, thus unmasking the underlying layer carrying the water immersion-indicating surface or indicia.

Depending on the type of physical operation involved, immersion of the golf ball for a sufficiently long period of time causes the opacification layer to either be rendered transparent, to be removed, or to reduce its light-blocking characteristics.

Note that golf ball manufacture is facilitated by using the opacification layer since the golf ball is otherwise the same as it always was and is merely overlain with the water-activated opacification layer. The application of this opacification layer is done in a single step process which is easy to implement. The layer itself is easy to make because all it has to be is a water-soluble, water-swellable or water-degradable layer, with no multi-component color formation system required. Alternatively, the opacification may be incorporated into the primer, paint or topcoat layers, and need not be a separately added layer.

Most importantly, for the underlying surface, any color or any image may be readily created and used to indicate water immersion and ultimately loss of golf ball performance. This is because the underlying surface over which the opacification layer is formed can be imprinted or colored at will without having to use color change processes.

When, for instance, insoluble pigment particles such as titania are used in a water-soluble carrier, upon immersion, the insoluble pigment particles tend to agglomerate or bind together, thus permitting viewing of the underlying portion of the golf ball which provides the altered appearance indicative of water immersion. The insoluble pigment particle embodiment provides a light-blocking function which prevents viewing of the underlying surface of the golf ball prior to the time that the golf ball has been sufficiently subjected to water. The light-blocking produced by insoluble pigment particles are the result of the even dispersement of the pigment particles in the binder, with the particles being relatively close together. However, when the binder is activated by subjecting the ball to water, the insoluble pigment particles bind together leaving open spaces through which the underlying surface is now visible.

The same type of operation can be achieved through the utilization of bubbles which are immobilized in a water soluble, water-swellable or water degradable binder. The bubbles diffract or reflect light so that what is underneath cannot be seen. When the binder is dissolved, swelled or degraded by ball immersion in water, the bubbles effervesce out. Bubbles can be considered to be simply voids in a binder layer or can be supplied by hollow particles or droplets with a different index of refraction than that of the binder.

Another way of obtaining the unmasking of the underlying golf ball surface is to provide clear light-scattering droplets such as those that might be provided by oil droplets which are immersible in the binder. These droplets are designed to have a significant difference in their index of refraction as opposed to that associated with the binder. When the oil is captured by the binder, the light-blocking associated with the droplets of oil prevents viewing the underlying golf ball surface. However, upon water penetration, the binder either dissolves, swells or degrades and the oil droplets propagate and leave open spaces to expose the underlying surface. The propagation also can provide a milky look to the underlying surface which again is indicative of water immersion.

Finally, the opacification layer may be completely dissolved or removed to expose the underlying surface. This can be accomplished not only by chemical dissolution or abrasion, but also by using microbial degradation in which microbes multiply within the opacification layer in response to the presence of water to eat portions of the opacification layer.

What is therefore provided is the ability to provide a golf ball with an underlying surface either carrying indicia or a particular color, including grey, which is to be exposed by an overlying light-blocking layer when the light-blocking capacity of the layer becomes impaired due to water immersion.

Thus, indicia initially may be imprinted on the underlying surface. Note the appearance of the underlying surface does not depend on a particular color change operation to be visible. This makes it relatively easy to imprint the underlying surface with any type of indicia, or in fact to provide the underlying surface with a wide variety of appearances.

The result is that a golf ball immersion-indicating system is provided in which whatever indicia of water immersion is desired, it is overcoated with an opacification layer that blocks light from reaching the underlying surface and thus makes the underlying surface invisible. Note, with the opacification layer altered through water immersion, the opacification layer either can be considered to become transparent or to be removed.

In summary, in order to provide a golf ball with a water immersion indicator, a golf ball with indicia or a particular recognizable color is overlain with an opacification layer that provides a mask over the indicia or the colored ball until such time as the ball has been immersed in water for a predetermined period of time affecting the ball's performance. The opacification layer when removed or otherwise made transparent, while providing for a change in the appearance of the golf ball upon water immersion, does not need to have a layer or indicia which changes color in reaction to the infusion of water. Rather the opacification layer is either removed or made transparent to expose an underlying colored surface or a surface bearing pre-determined indicia, thus to alter the appearance of the ball when it has been immersed in water for a period of time which affects golf ball properties. The subject system provides an easy way to make indicia visible upon water immersion since one does not have to create the indicia in response to water activation, but rather uncover already-printed indicia due to the removal or transparency of the opacification layer. Opacification reduction or elimination is accomplished through a number of physical processes involving a water-activated binder and either insoluble pigment particles, effervescing bubbles, the use of transparent oils, agglomeration or the complete or partial removal of the opacification layer.

BRIEF DESCRIPTION OF THE DRAWINGS

These and other features of the subject invention will be better understood in connection with a Detailed Description, in conjunction with the Drawings, of which.

DETAILED DESCRIPTION

Figure 1:
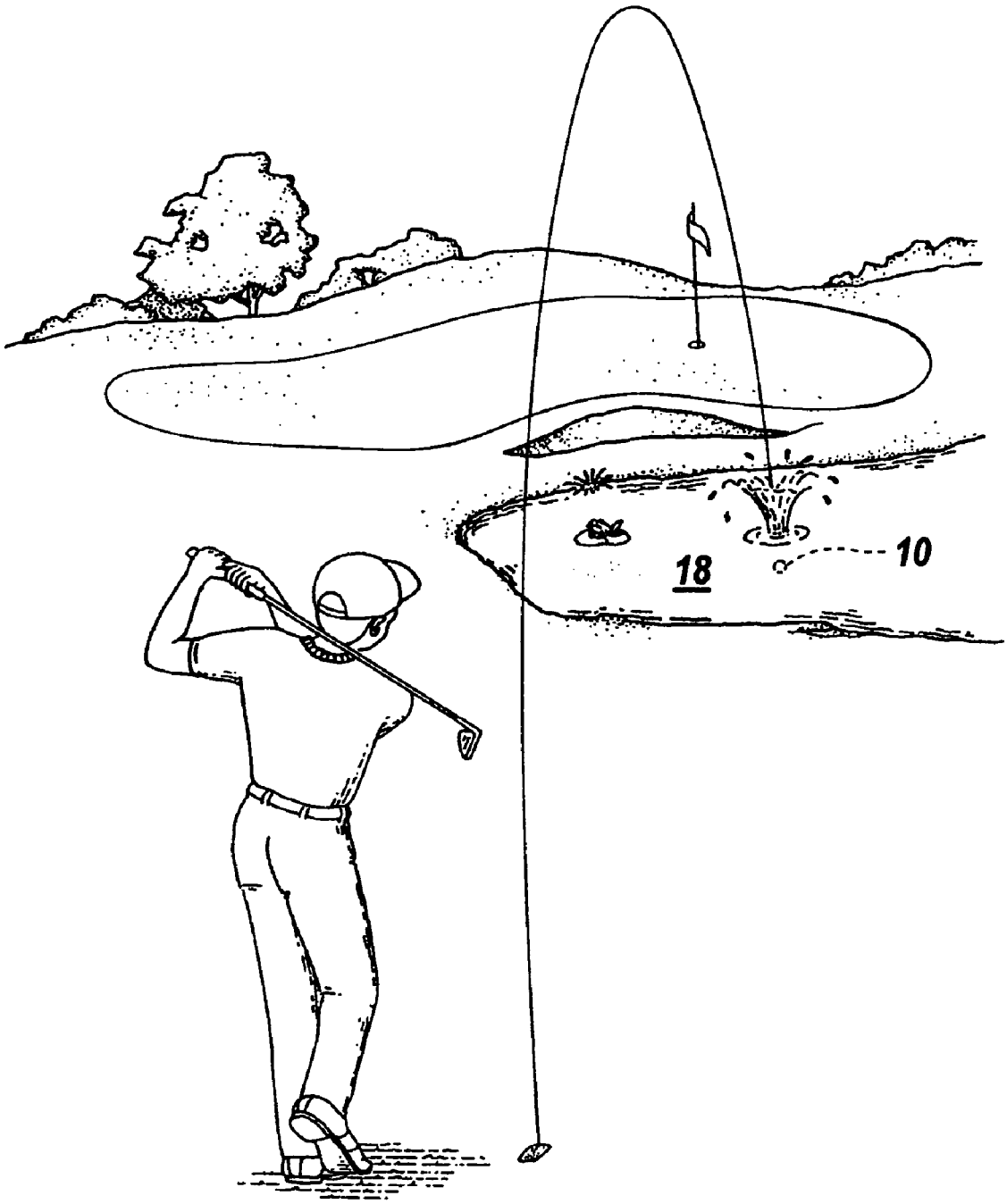
FIG. 1 is a diagrammatic illustration of a golfer hitting a golf ball into a water hazard.

Referring now to FIG. 1, as described in U.S. Pat. No. 6,277,037 in a typical situation, a ball 10 has been hit by a golfer 12 into a water hazard 13, where it resides until it is plucked out either by the golfer or by a company which retrieves golf balls from water hazards. Golf balls which are subjected to adverse conditions involving exposure to water for instance left out over the winter in the snow or left in a leafy marsh can likewise absorb water which deleteriously affects performance. It will be appreciated that such balls when subjected to water for a period of time lose their flight characteristics and regardless of their being washed and resold, will not regain these characteristics due to the immersion.

Figure 2:
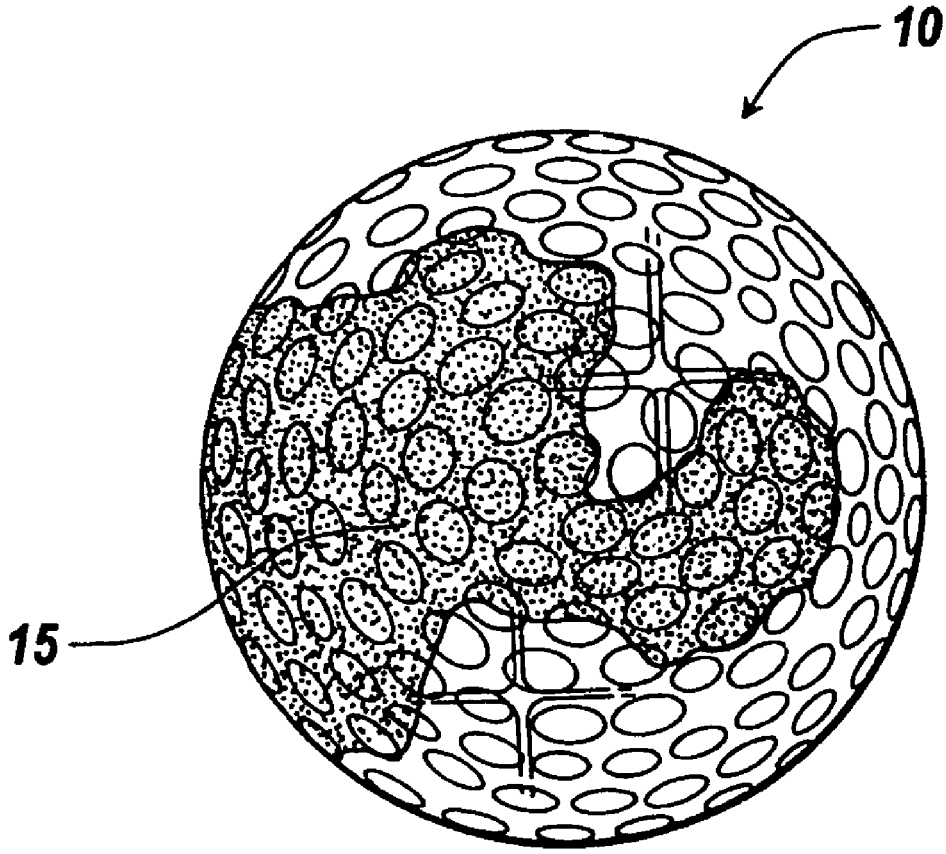
FIG. 2 is a diagrammatic illustration of the ball of FIG. 1 after immersion in water, showing a visual indication that the ball has been immersed in water for an extended period of time.

In order to provide an indicator of golf balls that have been subjected to water for some time, and referring now to FIG. 2, it can be seen that golf ball 10 is provided with a mottled appearance 15, which serves as an indicator that the ball has been immersed in water.

It is this or some other indicator which is water activated that provides a convenient method for one who finds or purchases a golf ball to ascertain that the ball is in fact a used ball and one which has been immersed in water for some time or has been subjected to some other adverse environmental condition.

As will be described, in one embodiment this distinctive discoloration or indication is provided through the utilization of a water soluble opacification layer which is activated through the infusion of water into the binder of the layer. The result of the infusion of water is that the opacification layer is rendered transparent or is fully or partially removed to expose a part of the golf ball indicating water absorption which will result in loss of performance. Note that it is immaterial as to what type of indication is given so long as the golfer purchasing or finding the golf ball can ascertain that it is in fact one that has been immersed in water or has been subjected to adverse environmental conditions for an extended period of time resulting in a loss of performance characteristics.

The length of time that it takes to alter or reduce the opacification layer is dependent on a number of factors. One does not want to alter the opacification layer for non-long term exposure to water as would occur from wet grass, ball washing and the like. As will be discussed, controlled alteration or reduction of the opacity of the layer involves characteristics of the binder in the opacification layer, the porosity of any overcoating or the particular chemistry of the particular opacification layer. Note that the degradation or removal of the opacification layer is correlated to the length of time it takes water to get into the golf ball and affect performance. For instance, it has been determined that water immersion for one week penetrates the core and causes a loss of approximately six yards of distance to a drive. Thus casual wetting is not sufficient to cause significant changes in ball qualities; but exposure after a number of days does.

Figure 3:
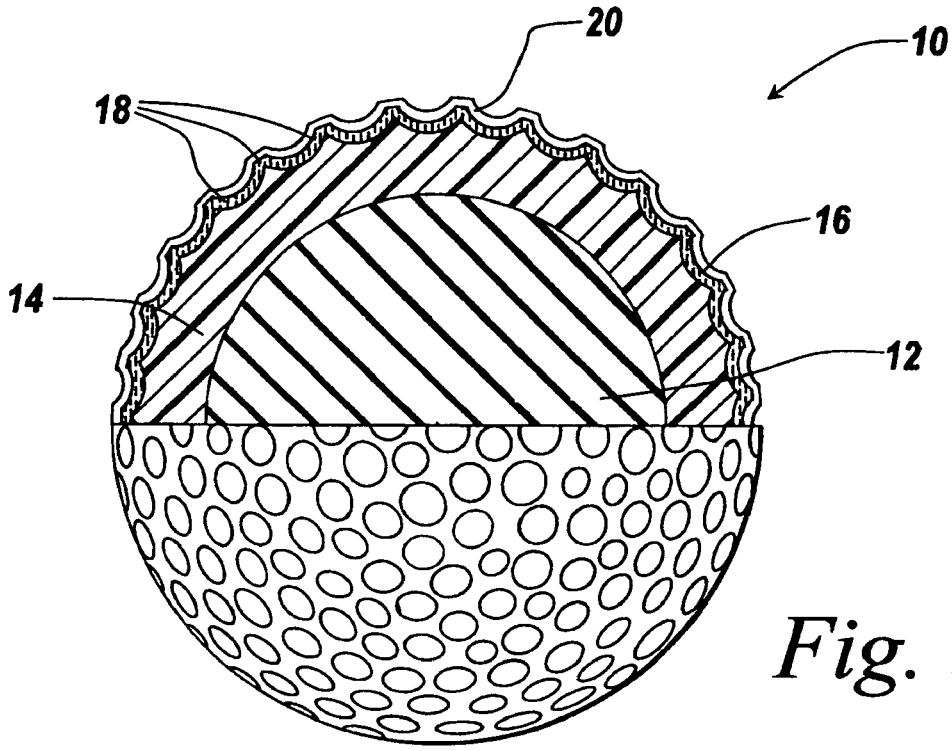
FIG. 3 is a diagrammatic illustration of a one-piece ball which provides a visual indicator of prolonged water immersion in which the ball includes a solid rubber core and a hard molded shell of an ionomer or ionomer blend such as Surlyn or a similar appropriate polymer resin, with the ball being covered with the subject opacification layer and a final gloss coat to maintain high gloss finish.

Referring now to FIG. 3, in one embodiment of the subject invention a conventional two-piece ball 10 with a solid rubber core 12 is illustrated having a hard molded shell 14 of an ionomer blend such as Surlyn, or a similar polymer resin. As can be seen, a conformal overcoat polymer dispersion 16 constitutes a water-activated opacification layer including a binder with opacification particles 18 therein.

The opacification layer is then covered with a final gloss coat 20 to protect the printing on the ball and also provides to some degree an additional diffusion barrier on the ball to slow down degradation of the opacification layer in humid environments.

Figure 4:
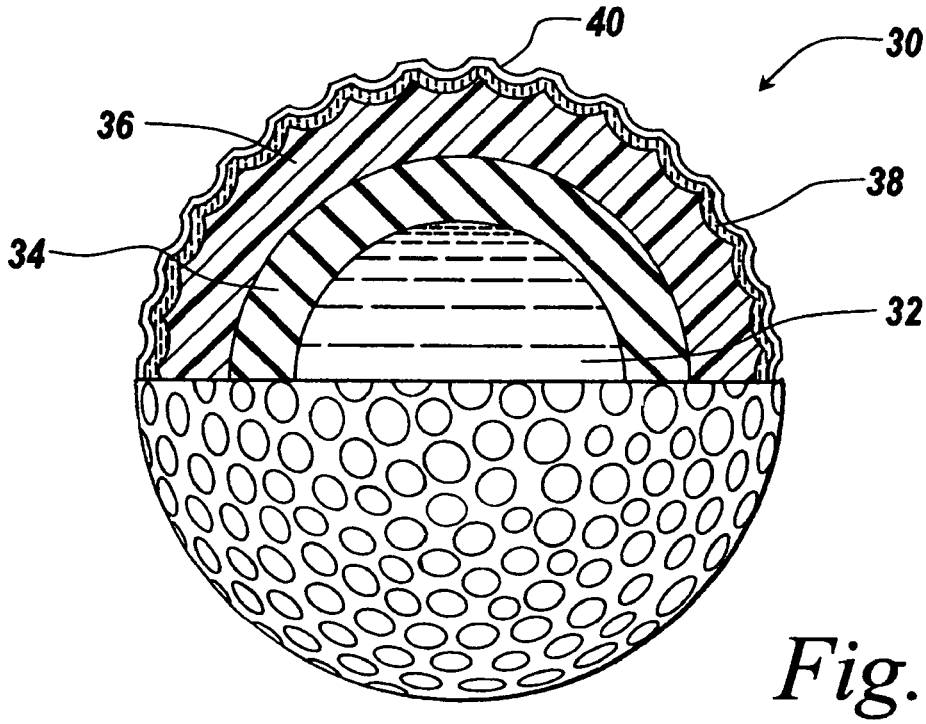
FIG. 4 is a diagrammatic illustration of a multi-piece ball which includes a solid, liquid or gel, a wound rubber band or molded rubber outer core and a shell of a glossy rubbery material such as balata rubber, polybutadiene blends or low shore hardness ionomer, the subject opacification layer and a gloss final coat.

Likewise, for a multi-layered ball as illustrated in FIG. 4, the multi-layered ball 30 is provided with a solid, liquid or gel inner core 32, an outer layer or mantel 34 and another layer or cover 36 of material such as balata rubber, urethane, polybutadyne blends, ionomer, or ionomer blend.

Note that the subject opacification overcoat layer 38 is formed underneath a final gloss coat 40.

Figure 5:
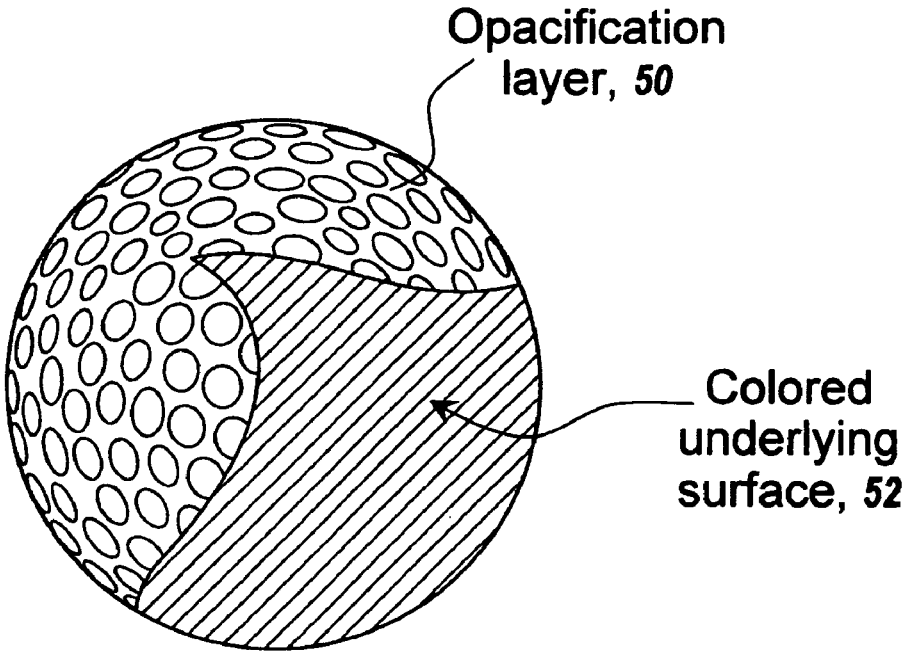
FIG. 5 is a diagrammatic illustration of the result of removing an opacification layer from a colored underlying surface, showing the underlying surface exposed to indicate extended water immersion.

Referring to FIG. 5, the important part of the subject invention is that the opacification layer here illustrated at 50 is somehow made to be removed or made to be transparent, in one embodiment to expose a colored underlying surface 52 which may be colored or may be gray or may be any nonwhite surface. As can be seen, with the transparency of the opacification layer or its removal or sloughing off, what is left after sufficient water immersion is an indication of the fact that the ball has been in the water for a period of time and has lost performance characteristics.

Figure 6:
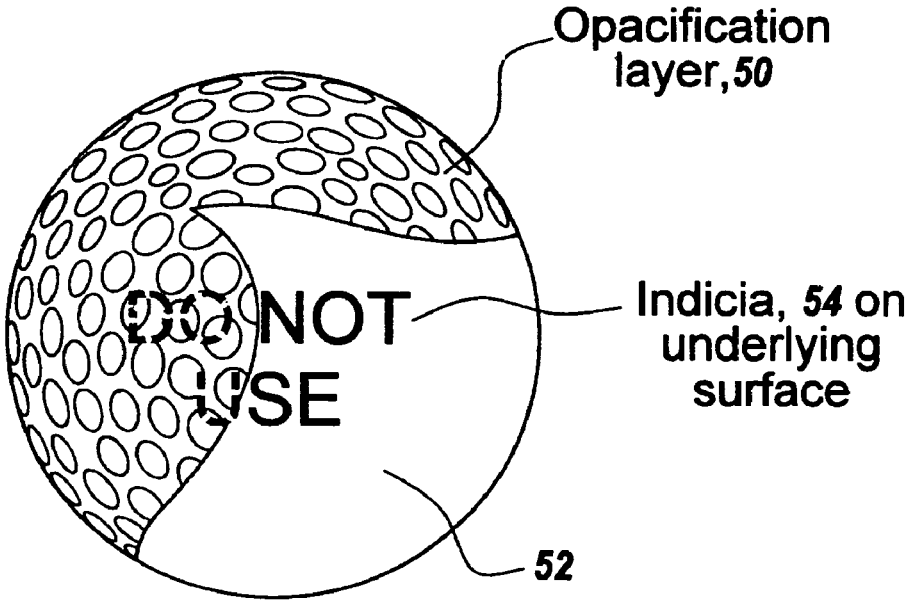
FIG. 6 is a diagrammatic illustration of the utilization of the subject opacification layer over indicia on an underlying surface, with the removal of the opacification layer exposing the indicia.

Referring to FIG. 6, opacification layer 50 covers indicia 54 on underlying surface 52 such that upon the transparency or the full or partial disappearance of opacification layer 50, whatever indicia is on surface 52 is exposed.

In this regard, it is noted that it is relatively easy to overprint any type of indicia on surface 52, with the overprinting or the color of the underlying surface being quite easily controlled and at the discretion of the ball manufacturer. It is therefore not a concern, for instance, on how the indicia is to look because it is painted, stamped or printed onto surface 52. Additionally, various indicia can simply be part of the molding process or be an inherent property of the underlying surface. Thus surface 52 itself can be made whatever color is desired by the ball manufacturer.

As a result, the opacification layer has no effect on the underlying surface and its purpose is merely to mask the underlying surface until it is activated so as to be rendered transparent or is fully or partially removed.

Figure 7:
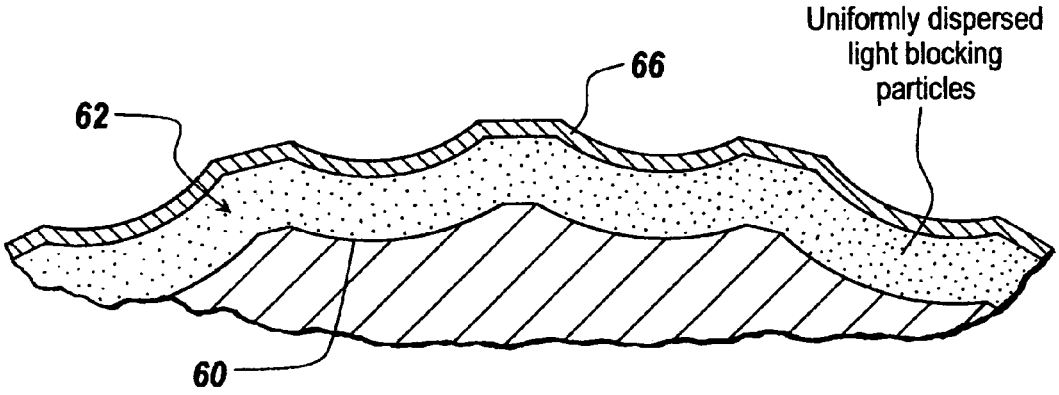
FIG. 7 is a diagrammatic illustration of an opacification layer having uniformly dispersed light-blocking particles such as pigments existing above a ball surface.

Referring to FIG. 7, what will be seen is that a ball surface 60 is provided with an opacification layer 62 in which uniformly dispersed pigment particles or light-blocking particles 64 are dispersed within the layer. In this case the opacification layer is provided with an overcoat 66, usually of polyurethane to provide the appropriate gloss and/or protection for the surface of the ball.

Figure 8:
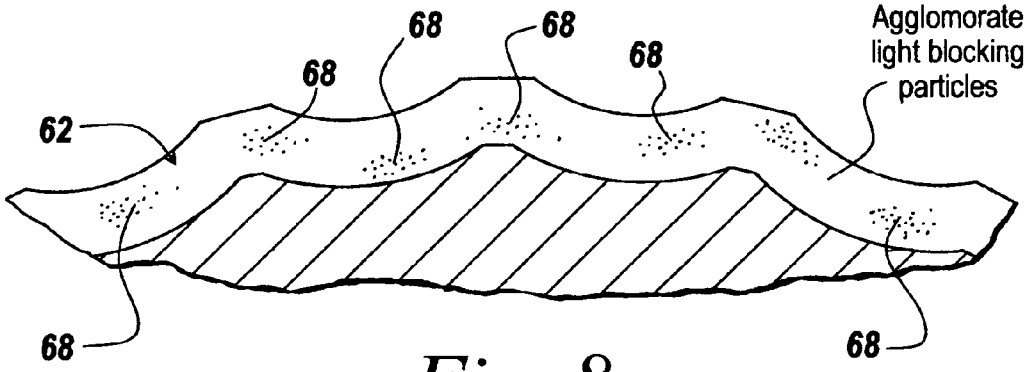
FIG. 8 is a diagrammatic illustration of the agglomeration of light-blocking particles upon water activation of the binding agent for the opacification layer.

Referring to FIG. 8, when a sufficient amount of moisture has entered into layer 62, a polymer binder either degrades, dissolves or swells by hydrolysis. As a result, particles 64 tend to migrate and agglomerate together as illustrated at 68 such that they no longer fully or partially mask the underlying surface 60.

It is not necessary for the opacification layer to become totally degraded or to slough off, it being understood that the agglomerated light-blocking particles are no longer sufficiently dense to block a view of the underlying surface. Note that degradation can be the result of microbial degradation in which microbes eat at least part of the opacification layer when the layer is exposed to water, with the water supplying a nutrient to cause the microbes to multiply and attack the opacification layer.

Figure 9A:
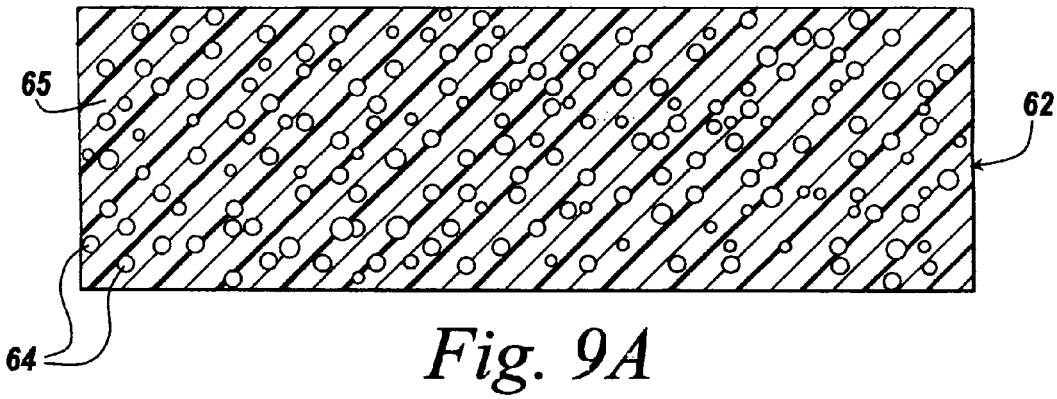
FIGS. 9A, 9B and 9C are diagrammatic illustrations of a pigment laden opacification layer showing no degradation or dissolution, 50% degradation or dissolution and 75% degradation or dissolution of the polymer binder showing that the pigment particles agglomerate as the polymer degrades, thus decreasing light-scattering efficiency.
Figure 9B:
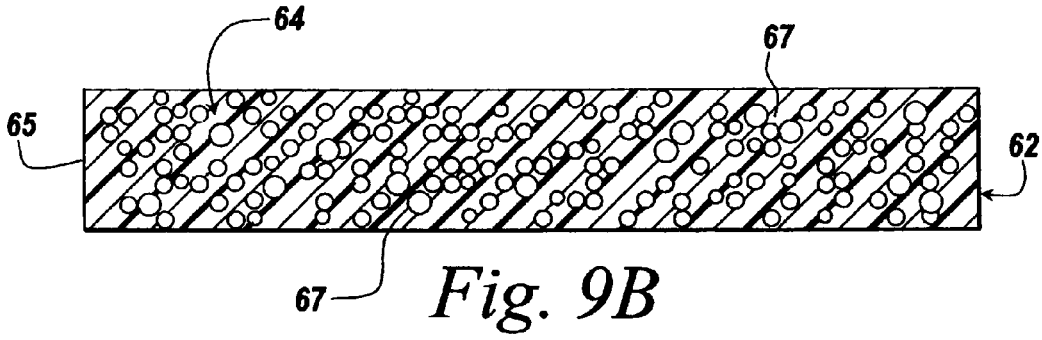
Figure 9C:
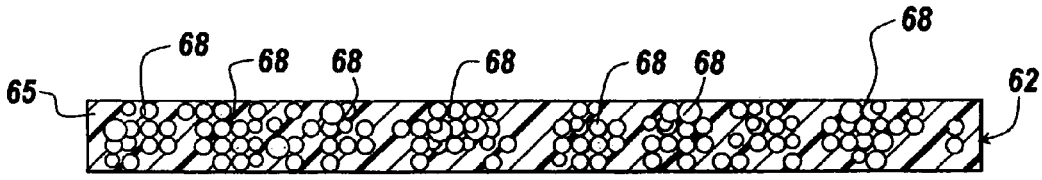

Referring to FIGS. 9A, 9B and 9C, the effect of degradation of the water-activated polymer binder is shown. In FIG. 9A, pigment particles 64 are uniformly dispersed in a polymer binder 65. When approximately 50% of the binder 65 has been degraded, dissolved or has swelled, particles 64 tend to agglomerate as shown at 67. This reduces the light-blocking efficiency of the opacification layer. As shown in FIG. 9C, at 75% binder degradation or dissolution, more significant agglomeration occurs as seen at 68, rendering the opacification layer even more transparent.

Figure 10:
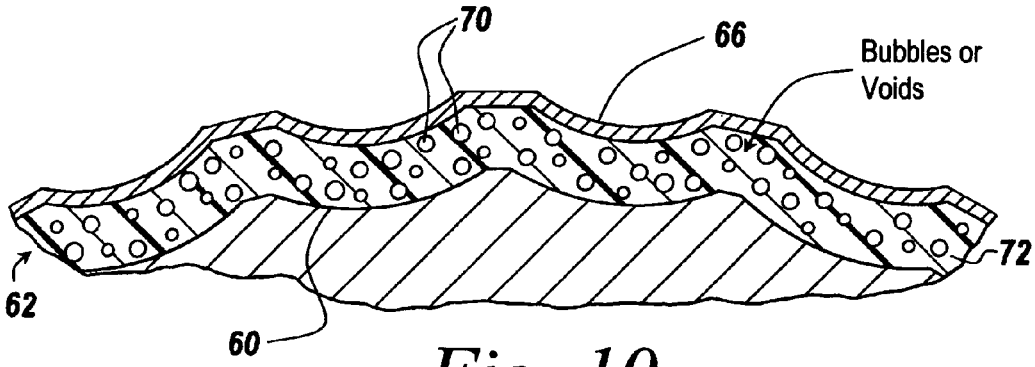
FIG. 10 is a diagrammatic illustration of the use of bubbles or voids within an opacification layer binder above a surface of a ball.

Referring to FIG. 10, opacification layer 62 is provided with bubbles 70 or binder 72 may be provided with voids.

It is the purpose of the bubbles or the voids to scatter incoming light so that no significant amount of light reaches surface 60, with the scattering providing a pleasing white appearance to the surface of the ball.

When one gets loss of opacification from the wetting of a water swellable or water soluble polymer that contains bubbles or voids, it softens allowing the bubbles to coalesce and/or effervesce or voids to collapse, thus reducing scattering and opacification.

Figure 11:
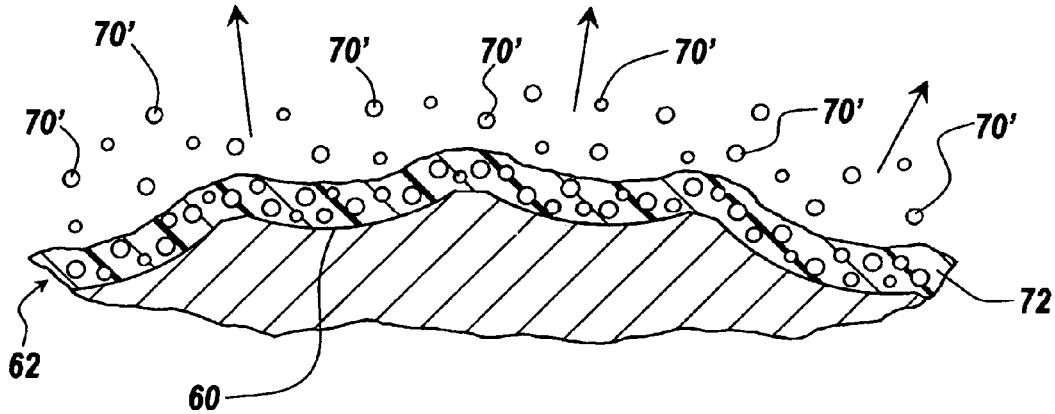
FIG. 11 is a diagrammatic illustration of the effervescing out of the bubbles or voids associated with the layer of FIG. 9, illustrating a diminution in the thickness of the opacification layer as well as the outgassing of the bubbles.

Referring to FIG. 11, upon water activation of opacification layer 62, the bubbles are evolved off as illustrated at 70' when binder 72 dissolves in the presence of water.

The result is that there is no light scattering or other mechanism by which the underlying surface 60 is occluded, which leads to the ability to view surface 60 and thus whatever indication it possesses.

Figure 12A:
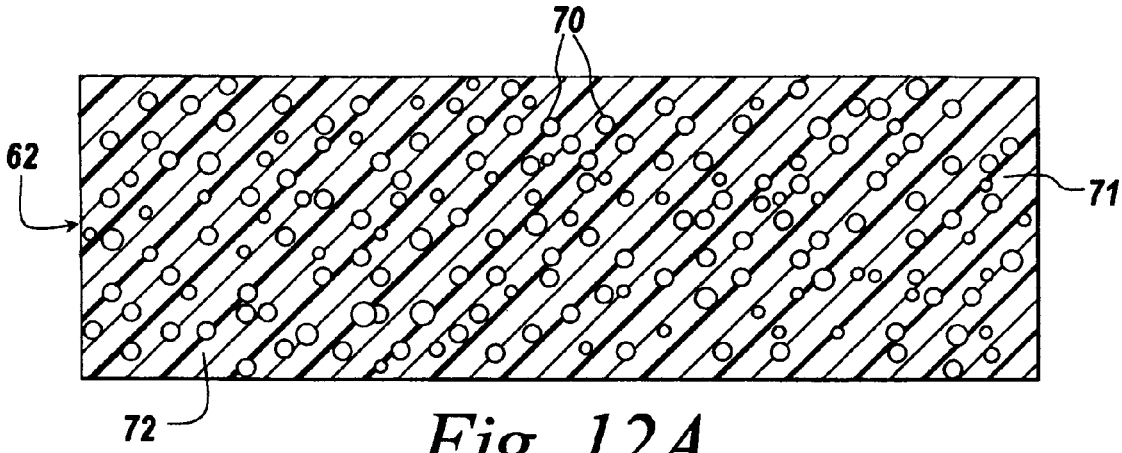
FIGS. 12A, 12B and 12C are diagrammatic illustrations of bubbles initially in a degradable polymer binder, the effect of 50% binder degradation or dissolution and the effect of 75% binder degradation or dissolution.
Figure 12B:
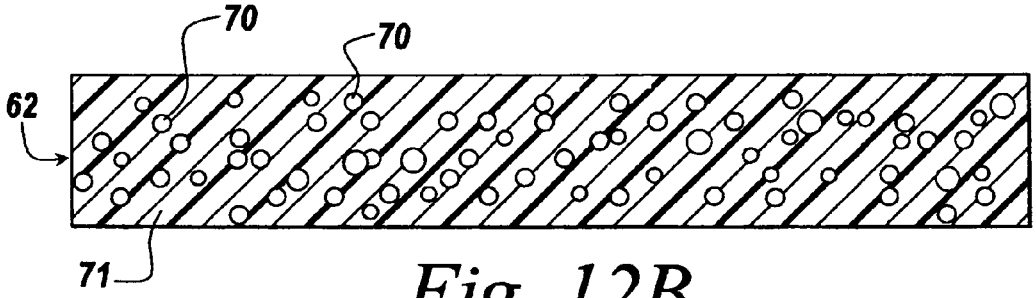
Figure 12C:
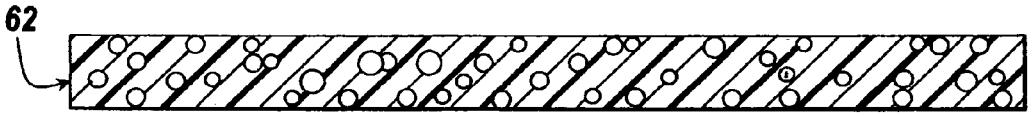

Referring to FIGS. 12A, 12B and 12C, FIG. 12A shows bubbles 70 uniformly dispersed in water-activatable binder 71. As shown at FIG. 12B with 50% degradation or dissolution of binder 71, bubbles 70 are less dense. With 75% binder degradation or dissolution as shown in FIG. 12C, many of the bubbles 70 have escaped, leaving layer 62 essentially transparent.

Figure 13:
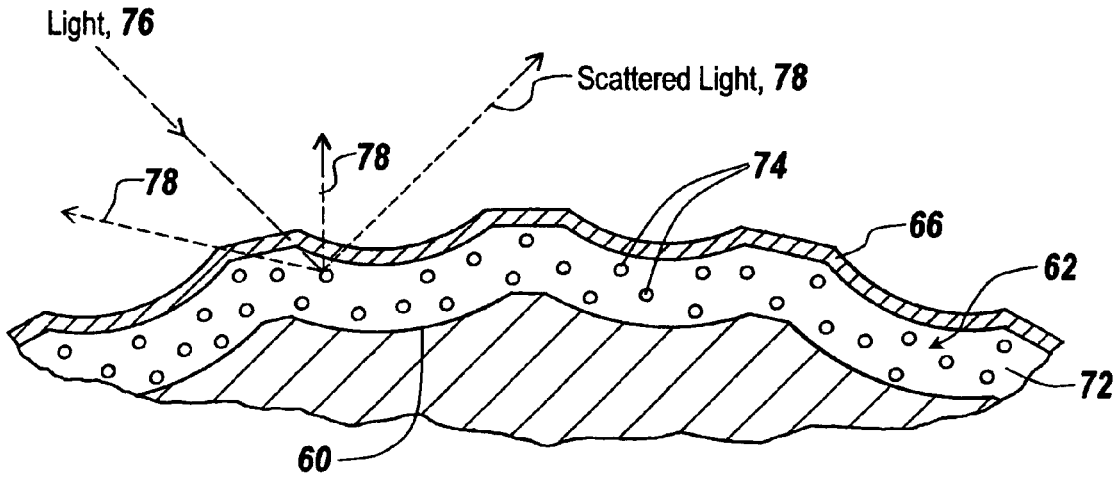
FIG. 13 is a diagrammatic illustration of an opacification layer having light-scattering particles therein, showing the scattering of the light, thus to provide the opacification layer with a white surface.

Referring to FIG. 13, it is possible rather than using bubbles or voids, layer 62 may be provided with light-scattering particles 74 whose index of refraction is much, much greater than that of the binder material 72.

In much the same way that the bubbles scatter light, these small particles scatter incoming light 76 in the directions illustrated at 78. As a result, what is visible from the surface of the ball is a white appearance. The reason for this is the relatively large difference between the indices of refraction of the particles and the binder, with the particles in one embodiment in the range 0.1-5 microns in diameter.

Figure 14:
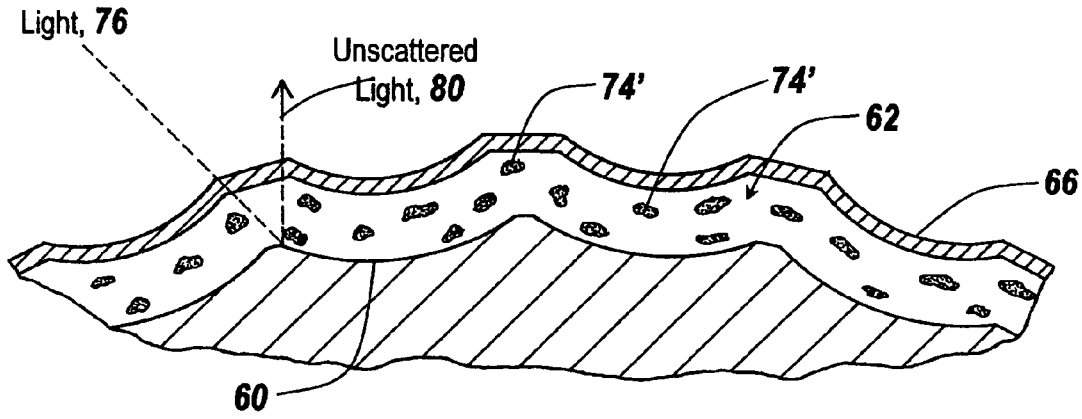
FIG. 14 is a diagrammatic illustration of the opacification layer of FIG. 13, when the opacification layer has been activated by water, thus to provide an agglomeration of the light-scattering particles, such that light, rather than being scattered, is not scattered, thus to provide a transparent look to the opacification layer.

Referring to FIG. 14, when opacification layer 62 is degraded, dissolved or otherwise destroyed, particles 74 agglomerate as illustrated at 74' much the same way as shown in FIG. 8. Here the particles, while initially being small enough to be refracting elements, are now made so large that they do not possess the light-refracting quality. This means that the agglomerated particles no longer scatter light but rather provide unscattered light 80 reflected by surface 60 so that surface 60 is visible. This means that the surface or any indicia thereon can be readily viewed upon water activation of opacification layer 62.

Figure 15:
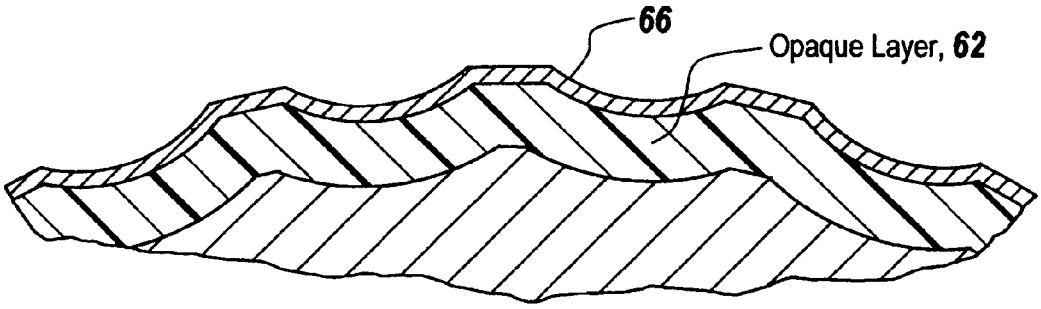
FIG. 15 is a diagrammatic illustration of a colored opacification layer which is light opaque and water actuatable, placed on an inner surface of the golf ball; and, FIG. 16 is a diagrammatic illustration of the dissolution, sloughing off or oblation of the opacification layer such that the opacification layer is removed to expose the underlying ball surface.
Figure 16:
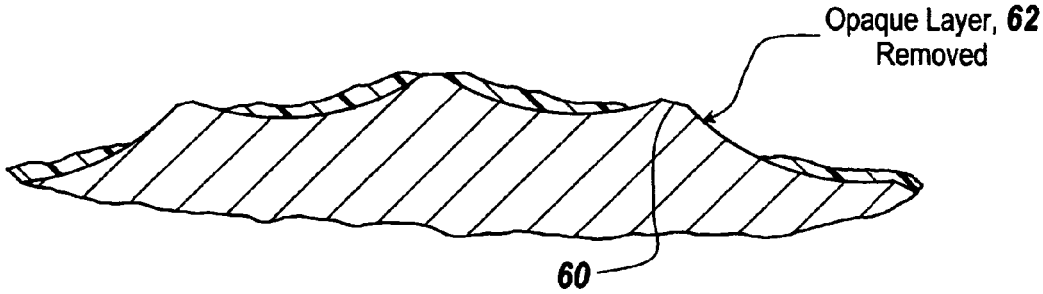

Referring now to FIG. 15, if opacification layer 62 is opaque as illustrated, then as illustrated in FIG. 16, with the opaque layer 62 removed, surface 60 is directly viewable due to the removal of the mask.

In all of the above cases the acrylic or polyurethane overlayer topcoat modulates the rate of water infusion to the opacification layer with water immersion. The top coat may, however, slow down the degradation, dissolution or swelling of the opacification layer to a limited extent and may be used as a further modulating element to control when the ball gives an indication that it has been submerged in water or exposed to water for a period of time that will affect golf ball performance.

What is now presented is a table listing the types of binder and additives that can be dispersed in the water-activated binder. Note that the binder can either be degraded or dissolved by water infusion or can be made to swell.

TABLE I

1. Insoluble Pigment in water degradable polymer matrix
Insoluble pigment particles dispersed in polymer to optimize scatter and opacification. When polymer binder degrades, particles agglomerate reducing scattering efficiency thereby reducing opacification. Assuming polymer needs to be degradable for required viscosity reduction for particle agglomeration.

| Water degradable polymers | Pigments |
|---|---|
| polylactic acid | Titania ($TiO_2$) |
| polylactic - polyglycolic acid copolymers | zinc oxide |
| polycaprolactam | barita (barium sulfate) |
| | alumina |
| | silica |
| | aluminosilicates |
| | calcium carbonate |
| | carbon black |
| polycaprolactone | |

2. Bubbles/Voids in water dissolvable or degradable polymer matrix
Bubbles or voids act as scatterers in polymer matrix. In this case, polymer needs to be water degradable or water swellable. The plasticizing of the polymer matrix with water will enable bubbles to coalesce or diffuse out of the matrix.

| Water degradable polymers |
|---|
| polylactic acid |
| polylactic - polyglycolic acid copolymers |
| polycaprolactam |
| polyanhydrides |
| polycaprolactone |
| **Water swellable polymers** |
| polyvinyl alcohol |
| polyacrylic acid |
| polyethylenimine |
| polyvinylpyrrolidone |
| polysaccharides |
| polypeptides |

3. Light scatterers dispersed in water degradable polymer matrix
Light scatterers (other than traditional insoluble pigments) dispersed in a water degradable polymer matrix. Light scatterers are particles or droplets of a material that have a significant difference in refractive index relative to surrounding binder. When the polymer binder degrades in the presence of water, the particles agglomerate or the droplets coalesce, greatly reducing scattering efficiency and opacity.

| Water degradable polymers | Scatterers |
|---|---|
| polylactic acid | Teflon beads |
| polylactic - polyglycolic acid copolymers | droplets of high refractive index oil |
| polycaprolactam | |
| polycaprolactone | |

4. Insoluble pigments, bubbles, voids, or light scatterers in a water dissolvable and/or degradable polymer matrix TABLE I-continued

| Water degradable polymers |
|---|
| polylactic acid |
| polylactic - polyglycolic acid copolymers |
| polycaprolactam |
| polycaprolactone |
| polyanhydrides |
| Water swellable polymers |
| polyvinyl alcohol |
| polyacrylic acid |
| polyethylenimine |
| polyvinylpyrrolidone |
| Polysaccharides |
| polypeptides |
| many examples |

With respect to methods for modulating the rate at which the opacification layer degrades, Table II below describes one example:

TABLE II

| Example 1 | |
|---|---|
| Polymer binder: | 5% wt/wt solution of polylactic acid – polyglycolic acid (PLGA) in ethyl acetate<br>PLGA was 50:50 polylactic:polyglycolic copolymer with an average molecular weight of 15,000. |
| Pigment: | 30% wt/wt of TiO2 (rutile) on polymer, average particle size = 1 micron |

In this example, the polymer binder/pigment was dip coated onto a melt extruded Surlyn® plaque and also onto a silated glass slide. The Surlyn® used to make the plaque was a type typically used in ionomer based gold ball covers. A solvent-based pad printing ink was printed onto the dried opacification layer.

The thickness of the opacification layer needed for 100% opacity is dependent on the loading, particle size, particle size distribution, and dispersion quality of the pigment particles. The thickness of the dip coated layer was approximately 1 to 2 microns which gave high opacity.

The samples were then spray overcoated with a solvent based clear urethane. Non-overcoated and overcoated samples were then immersed into water to evaluate the time for the coating to degrade and slough off. The time for non-overcoated samples to have the opacification layer to slough off was approximately 1 week.

Modulation of Polymer Degradation Rate

There are a number of factors that can modulate the rate at which PLGA and other degradable polymers degrade. In the case of PLGA, the ratio of poly-lactic to poly-glycolic will modulate the rate where a higher poly-glycolic ratio will increase rate of water degradation or decrease time to dissolution. A higher poly-lactic acid will slow the rate of water degradation. Other rater modifiers are listed in Table III below:

TABLE III

| |
|---|
| Molecular weight: higher MW = slower rate Lower Mw = faster rate |
| Acid terminated functional groups will accelerate water degradation |
| Accelerants: addition of acidic or basic compounds to the polymer matrix will accelerate degradation. |
| Permeators: hydrophilic substances (i.e. other polymers) or particle disrupters (particles that generate channels in the polymer matrix) will facilitate water infusion into the polymer film and will accelerate degradation. |

While the present invention has been described in connection with the preferred embodiments of the various figures, it is to be understood that other similar embodiments may be used or modifications or additions may be made to the described embodiment for performing the same function of the present invention without deviating therefrom. Therefore, the present invention should not be limited to any single embodiment, but rather construed in breadth and scope in accordance with the recitation of the appended claims.

What is claimed is:

1. A method for providing a golf ball with a visual indication that a property has been altered due to the presence of water in the golf ball, comprising: applying a water-activated mask that is altered to permit viewing of a covered indicator upon being subjected to water, wherein the mask functions, prior to water activation, as an opacification mask.

2. The method of claim 1, wherein the mask alteration includes changing the refractive index of the mask.

3. The method of claim 1, wherein the mask alteration includes at least partial degradation of the mask.

4. The method of claim 3, wherein the partial degradation includes at least a partial sloughing off of the mask.

5. The method of claim 3, wherein the partial degradation includes microbial degradation.

6. The method of claim 1, wherein the covered indicator of the golf ball has a predetermined color.

7. The method of claim 1, wherein the covered indicator includes indicia.

8. The method of claim 7, wherein the indicia are printed indicia.

9. The method of claim 7, wherein the indicia are embedded indicia.

10. The method of claim 1, wherein the mask is at least partially dissolved by water.

11. The method of claim 1, wherein the mask is at least partially removed in the presence of water.

12. The method of claim 1, wherein the mask is made at least partially transparent upon water activation.

13. The method of claim 1, wherein the mask includes a water-activated binder.

14. The method of claim 13, wherein the binder includes insoluble pigment particles.

15. The method of claim 13, wherein the binder include bubbles.

16. The method of claim 13, wherein the binder includes voids.

17. The method of claim 13, wherein the binder includes oils.

18. The method of claim 1, wherein the mask includes light-blocking media and wherein the unmasking includes agglomeration of the light-blocking media, thus to at least partially expose the covered indicator.

19. The method of claim 1, wherein the mask includes light-blocking media.

20. The method of claim 19, wherein the light-blocking media includes pigment particles.

21. The method of claim 19, wherein the light-blocking media includes a water-activated binder with bubbles therein.

22. The method of claim 19, wherein the light-blocking media includes a water-activated binder with voids therein.

23. The method of claim 19, wherein the light-blocking media includes a water-activated binder and droplets of oil therein.

24. The method of claim 13, wherein the binder includes a water degradable polymer.

25. The method of claim 24, wherein the water degradable polymer is at least one of poly lactic acid, poly lactic-polyglycolic acid copolymers, polycaprolactam and polyanhydrides.

26. The method of claim 24, wherein the water degradable polymer is chosen from polymers having microbes embedded therein that multiply in the presence of water, wherein the water acts as a nutrient for the microbes, thus to cause degradation of the water-degradable polymer.

27. The method of claim 26, wherein the water degradable polymer, is at least one of polysaccharides, polypeptides, polyvinylalcohols, polyacrylic acids, and polyesters.

28. The method of claim 13, wherein the binder is water swellable.

29. The method of claim 28, wherein the water swellable binder is one or more of polyvinyl alcohol, polyacrylic acid and polyethylenimine.

30. A method for providing a golf ball with a visual indication that a property has been altered due to the presence of water in the golf ball, comprising: applying a water-activated mask that is altered to permit viewing of a covered indicator upon being subjected to water, wherein said mask functions, prior to water activation, as an opacification mask in which the mask has a structure which makes the mask opaque.

* * * * *